US010800500B2

(12) United States Patent
Siverts

(10) Patent No.: US 10,800,500 B2
(45) Date of Patent: Oct. 13, 2020

(54) PADDLE FOR STAND UP PADDLE BOARDS

(71) Applicant: Curt Siverts, Redondo Beach, CA (US)

(72) Inventor: Curt Siverts, Redondo Beach, CA (US)

( * ) Notice: Subject to any disclaimer, the term of this patent is extended or adjusted under 35 U.S.C. 154(b) by 0 days.

(21) Appl. No.: 15/265,840

(22) Filed: Sep. 14, 2016

(65) Prior Publication Data

US 2019/0270499 A1 Sep. 5, 2019

Related U.S. Application Data

(60) Provisional application No. 62/218,156, filed on Sep. 14, 2015.

(51) Int. Cl.
*B63H 16/04* (2006.01)
*B63B 32/00* (2020.01)

(52) U.S. Cl.
CPC ..... *B63H 16/04* (2013.01); *B63B 32/00* (2020.02)

(58) Field of Classification Search
CPC ..... B63H 16/04
USPC ..... 441/79
See application file for complete search history.

(56) References Cited

U.S. PATENT DOCUMENTS 4,527,984 A * 7/1985 Gilbert ..... B63B 35/811 440/101
4,804,347 A * 2/1989 Ross ..... B63B 35/793 114/357
5,558,553 A * 9/1996 Okano ..... B63B 35/83 440/101
6,106,347 A * 8/2000 Harness ..... B63B 35/7926 441/68

* cited by examiner

*Primary Examiner* — Stephen P Avila
(74) *Attorney, Agent, or Firm* — Richard B. Cates

(57) ABSTRACT

A paddle for stand-up paddle boards and other water craft includes a paddle blade at a lower end of the paddle shaft and a skeg/fin extending from the lower edge of the paddle blade. A method and system for transporting a user across water or other surfaces has a board or other water craft for the user to stand/sit upon and a paddle with the skeg/fin extending from the paddle blade.

17 Claims, 7 Drawing Sheets

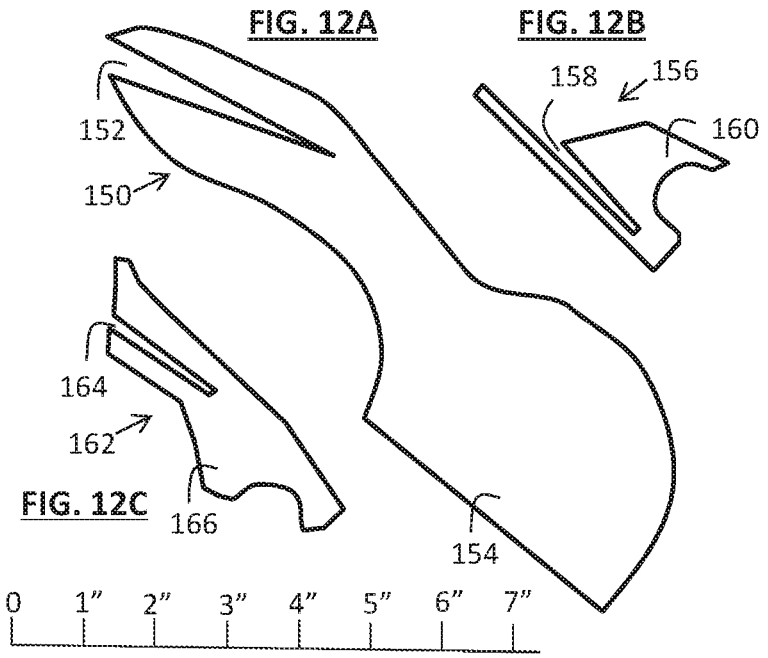
FIG. 12A
FIG. 12B
152
150
158
156
160
164
162
166
154
FIG. 12C
0
1"
2"
3"
4"
5"
6"
7"
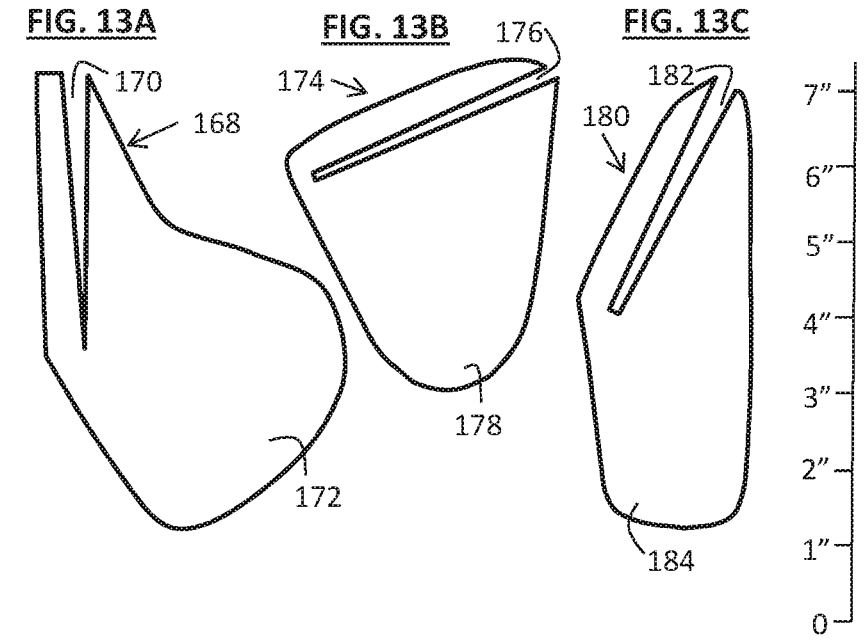
FIG. 13A
FIG. 13B
FIG. 13C
170
168
172
174
176
178
182
180
184
7"
6"
5"
4"
3"
2"
1"
0

PADDLE FOR STAND UP PADDLE BOARDS

RELATED APPLICATIONS

The current application claims priority to U.S. Provisional Patent Application No. 62/218,156, filed Sep. 14, 2015, the entire contents of which are incorporated herein by reference. The current application is also related to U.S. Utility patent application Ser. No. 13/869,020, filed Apr. 23, 2013, and also U.S. Provisional Patent Application No. 61/802,242, filed Mar. 15, 2013, and also U.S. Provisional Patent Application No. 61/688,837, filed May 22, 2012, and also U.S. Provisional Patent Application No. 61/687,279, filed Apr. 23, 2012, the entire contents of each of which are incorporated herein by reference.

FIELD OF THE INVENTION

The present invention relates to the field of standup paddle boards and other paddle-driven watercraft, where a person is positioned on or in a paddle board or other paddle craft and propels himself/herself through the water using a paddle via a paddling motion.

BACKGROUND OF THE INVENTION

Paddles, including oars, are commonly used to propel manually-driven watercraft through the water. For example, paddle boarding is a sport where a relatively large and buoyant surfboard-like board is used, with a user standing on the board and paddling using a paddle having a relatively long shaft with a blade at one end, and often a handle at the other. The relatively long shaft permits the user to dip the blade into the water from a standing position in order to drive the board forward via the blade engaging the water. A user can stand on the SUP board and paddle with the long-shafted paddle. The user can paddle the board over relatively flat water and, depending on the strength and skill of the user, in relatively rough water. Skilled SUP boarders can even use the paddle and board to surf waves.

Paddles for paddle boards and other watercraft have a power face and a non-power face, where the power face is the face that is pushed against the water during the paddling stroke (and is also typically the side facing to the rear of the watercraft during the paddling stroke), and the non-power fare is the opposing side.

One problem with SUP boards and some other paddle craft is the tracking. The current invention came about by trying to figure out how to improve SUP board tracking. With many SUP boards, a user only gets about three paddle strokes on a side of the board before the user needs to switch the paddle to the other side of the board. One option is to stick a rudder on a SUP board in order to go straighter longer; however, adding a rudder to an SUP board can be relatively expensive and complicated.

A problem with many paddle blades is that when pushed through the water they can flutter (aka wobble), which is the tendency of the paddle blade to move side to side (i.e., edge-to-edge) when the paddle power face is pushed through the water. This flutter/wobble can increase the user's effort required to paddle the board, such as by making the user grip the paddle shaft tighter and apply physical efforts to reduce the side-to-side movement of the paddle. Flutter/wobble can increase user fatigue, reducing the speed of the craft and the distances travelled, and also reducing the user's enjoyment.

Flutter/wobble is widely believed to be caused by the displacement of water during a paddle stroke, where the power face is forced against and through the water, thus creating higher water pressure on the power face than on the non-power face so that the water will tend to move from the power face, around the paddle edges, and then to the non-power face. This water flow can form flow patterns which create unequal forces across the power face, resulting in blade wobble. Various anti-wobble paddle blade designs have been proposed. One notable and well-accepted design is the so-called dihedral paddle blade, which has a complex 3-dimensional dihedral shape on the power face. This dihedral shape was designed to direct water to flow evenly across the power face and off opposing edges of the blade to encourage a smooth and stable stroke. The dihedral thus provides direction for the water to flow evenly off the blade, minimizing flutter/wobble.

Paddles are known with relatively low-profile rib-like structures on either or both faces, with multiple rib-like structures passing a relatively long distance lengthwise (i.e., top-to-bottom) along the blade face. These ribs generally provide stiffness to the blade, but in some cases may also smooth the flow of water from the top to the bottom of the blade during rowing. However, the effectiveness of ribs on smoothing or otherwise impacting the flow of water was doubtful, especially ribs on the non-power face. The general thought in the art was that ribs had at best a minimal effect on fluid flow or at worst were actually detrimental to the fluid flow during a paddle's operation. For example, one author stated the following: "As a general rule (there are always exceptions) ribs on the side of the blade facing the back of the boat (powerface) have a detrimental effect, and ribs on the other side of the blade (non-powerface) don't matter very much." (Online article by Hank Hayes at http://www.touringkayaks.com/paddle_shape.htm.)

Some users need different paddle blade performance depending on the particular use on a particular day. For example, a user may be confronted with different paddling conditions (e.g., high surf vs. relatively flat water), or may have different performance needs (e.g., racing vs. cruising). Many users will have entirely different paddles, with different performance levels, from which they choose depending on the desired use. However, purchasing and maintaining multiple paddles can be expensive. One solution has been to develop paddles with interchangeable blades, where the user can disconnect one blade from the paddle shaft and replace with a blade having different shape/size.

There is a need for a paddle design that prevents wobble while preserving paddle performance, and which can permit a user to selectively modify the paddle to meet various performance requirements. The current invention meets this need.

SUMMARY OF THE INVENTION

The invention comprises systems, methods, and devices for paddling watercraft such as stand-up paddle boards, and more particularly for using one or more fin-like projections extending from the paddle blade to minimize the tendency of the blade to flutter/wobble, and to improve paddle and water vehicle tracking through the water. The invention may be applicable to various types of paddles, including SUP paddles, kayak paddles, canoe paddles, outrigger paddles, rowboat oars, etc.

This invention addresses the problem of oscillations/wobble of the paddle blade as it is drawn through the water during a paddling stroke. To prevent blade wobble and to improve SUP board tracking, a skeg or fin is placed on the blade, and preferably on the lower portion of the paddle blade, which may extend along the blade's centerline and down to and past the blade's outermost (aka lower or distal) edge. The skeg/fin helps to propel the user more efficiently through the water by preventing/controlling blade wobble/oscillations. The skeg/fin also serves a keel-like purpose, guiding the paddle while keeping the board tracking straighter longer and thus allowing for more strokes on either side of the board by the user before having to switch the paddle strokes to the other side of the board (or other water craft).

With traditional SUP paddles and boards, a user typically only gets a few strokes on any side of the board before the user needs to switch the paddle to the other side of the board in order to keep the board on a relatively straight course. (Note that this number of strokes per side is also very user and board dependent, with advanced users and better-tracking boards able to perform more strokes per side before changing sides.) This invention came about by trying to figure out a way to improve steering/tracking of SUP boards, but without having to stick a rudder on a SUP board. The solution was to put the "rudder" on the blade, which is both cheaper and more efficient.

In an embodiment of the invention, a stand-up paddle is provided with a skeg/fin on the paddle blade. The paddle blade has a skeg/fin at its lower edge, with the skeg/fin being centered on the blade in some embodiments of the invention. The skeg/fin may be perpendicular to the paddle blade, and may extend well below (i.e., distally of) the paddle blade and/or may extend outwardly from the non-power side of the paddle blade. The skeg/fin may be centered on the paddle blade, and/or aligned with the paddle shaft so that a plane defined by the fin passes through the paddle shaft.

A skeg/fin according to embodiments of the invention may extend distally of a distal end of the paddle blade by at least 0.5 inches, at least 1 inch, or more. A skeg/fin may have a side profile area of at least 1 square inch, at least 2 square inches, at least 3 square inches or more, and the portion of the side profile area that is positioned distal of the paddle blade may be at least 1 square inch; at least 2 square inches; or more. A skeg/fin may extend outward from a non-power side of the paddle blade by at least 0.5 inches, at least 1 inch, at least 2 inches, or more. The portion of the side profile area that is positioned outward from the non-power side of the blade may be at least 1 square inch; at least 2 square inches; at least 3 square inches; or more.

Other paddles are also within the scope of the invention. For example, for a kayak paddle, paddle blades may be positioned at both ends of the paddle, with one or both of the paddle blades having a skeg/fin. Paddles according to the invention may be used as oars, such as used on in oar locks of a boat. The skeg/fin may preferably be thin and blade-like, with a thickness over most of the skeg/fin of less than 5 mm, or less than 4 mm, or less than 3 mm, or less than 2 mm, or less than 1 mm. The edges of the skeg/fin may be rounded and/or relatively sharp, as opposed to flat-edged, to encourage water to flow smoothly over a leading edge and off a trailing edge as the skeg/fin slices through the water, such as during a power stroke.

One purpose of the skeg/fin is to reduce oscillations/wobble, which results in a more efficient paddle stroke. This may enable the user to use a wider blade with significantly reduced oscillations/wobble, which will allow the user to move more water during each stroke, resulting in a greater thrust to speed ratio, thus traveling faster using less energy. A skeg/fin extending below the paddle blade which is aligned with the direction of the power stroke and/or perpendicular to the paddle blade can act as guide for the paddle, with the skeg/fin helping to slice through the water and resisting and/or preventing side-to-side movement of the paddle during the power stroke. The skeg/fin may serve as a sort of mini keel and/or rudder, allowing the board to stay straighter longer. The skeg/fin may act in a manner similar to the feathers on an arrow, with the skeg/fin helps to keep the paddle blade in a desired course through the water, such as by inducing a small amount of drag al the centerline of the trailing/non-power side of the paddle to thereby keep the paddle centered/balanced.

An embodiment of the invention is a system for transport over water, with a stand up paddle board configured for a person to stand thereon; a paddle, wherein the paddle comprises a paddle shaft having a distal end and a proximal end, a paddle blade secured to the paddle shaft proximal end, and a skeg/fin secured to a lower edge of the paddle blade, where the skeg/fin is perpendicular to the paddle blade.

A method of traveling across the water surface on a paddle board according to an embodiment of the invention comprises: placing a paddle board in the water; holding a paddle in a hand of the user, wherein the paddle comprises a paddle shaft having a proximal and a distal end, wherein a paddle blade is secured to the proximal end and a skeg/fin is secured to the paddle blade, wherein the user holds the paddle by the paddle shaft; the user standing on the upper surface of the paddle board; the user paddling the board with a power stroke by placing the paddle blade in the water and pushing against the water via the paddle blade; and the user resetting the paddle by pulling the paddle blade forward with the blade out of the water but with the skeg/fin at least partially in the water.

Paddle blades according to the invention may be used with other paddle features, such as an in-shaft sail assembly such as that disclosed in U.S. Utility patent application Ser. No. 13/869,020, filed Apr. 23, 2013, now U.S. Pat. No. 9,033,753, and also U.S. Provisional Patent Application No. 61/802,242, filed Mar. 15, 2013, and also U.S. Provisional Patent Application No. 61/688,837, filed May 22, 2012, and also U.S. Provisional Patent Application No. 61/687,279, filed Apr. 23, 2012, the entire contents of each of which are incorporated herein by reference.

BRIEF DESCRIPTION OF THE DRAWINGS

FIG. 12A-12C depict side views of various designs for skegs/fins according to embodiments of the invention;

FIG. 13A-13C depict side views of various designs for skegs/fins according to embodiments of the invention;

DETAILED DESCRIPTION OF PREFERRED EMBODIMENTS

Figure 1:
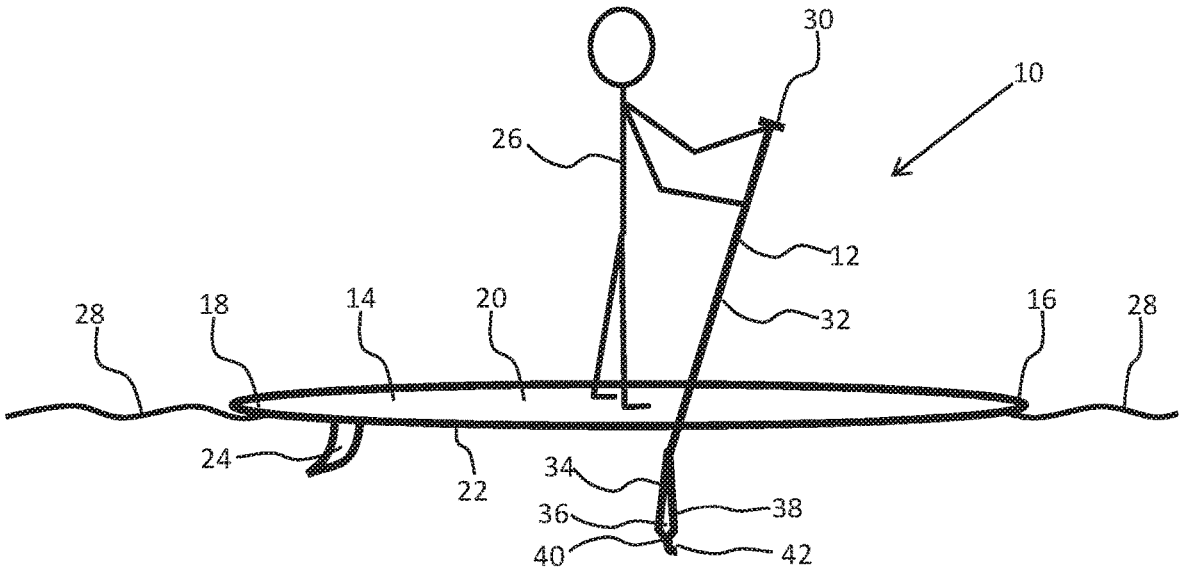
FIG. 1 depicts a perspective view of a system in use by a user according to an embodiment of the invention.

As depicted in FIG. 1, a system 10 according to the invention comprises a paddle 12 and board 14. The board 14 has a board front end 16, board rear end 18, board top 20, and board bottom 22. A board fin 24 extends from the board bottom 22 at a position toward the rear end 18 of the board 14. Note that additional board fins may be present on the board, including fins positioned elsewhere along the length of the board. A user 26 is depicted standing on the board top 20, with the board 14 positioned on the water 28 and the user 26 facing toward the board front end 16. The user 26 grasps the paddle 12, which in the particular depiction includes the user 26 grasping the paddle handle 30 with one hand and grasping the paddle shaft 32 with the other hand. The paddle blade 34 has a power face 36 which is depicted facing rearward with respect to the board 14 and user 26 and which is driven against the water during a power stroke to drive the board 14 forward, and non-power face 38 which is depicted facing forward with respect to the board 14 and user 26. The blade 34 widens at its lower portion 39. Extending from the blade lower portion 39 is a blade skeg/fin 42. In the particular embodiment depicted extends downward from the blade lower edge 40 (aka "distal edge") and also in a direction away from the non-power face 38 (which in the depiction of FIG. 1 is also in the forward direction with respect to the board 14).

Figure 2A:
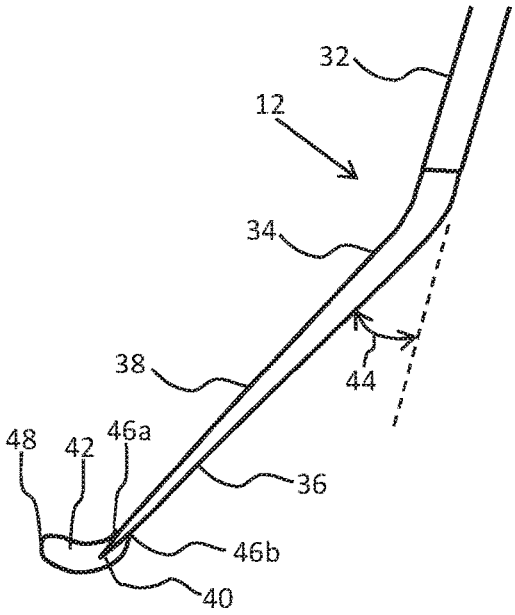
FIGS. 2A-2B depict a perspective view and side of a paddle according to an embodiment of the invention.
Figure 2B:
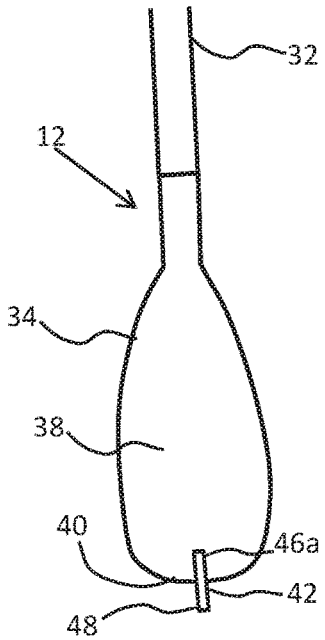

FIGS. 2A-2B depict close-up views of a paddle blade 34 according to an embodiment of the invention, where FIG. 2A is a side view of the blade and FIG. 2B is a front view of the non-power face of the blade. The paddle blade 34 is depicted as projecting at an angle 44 from the paddle shaft 32. The angle 44 depends on the particular embodiment. For some paddles, the angle is zero. For many SUP paddles, the angle 44 is between 7 and 12 degrees. The purpose of the angle 44 is to present the power face 36 at a better angle of attack to the water when the paddle blade 34 is pressed against the water during a power stroke.

A skeg/fin 42 extends from the paddle blade 34. The skeg/fin 42 has a proximal end 44. In the particular embodiment depicted, a portion 44*a* of the proximal end is positioned on and secured to the non-power face 38, and another portion 44*b* of the proximal end is positioned on and secured to the power face 36. Positioning the proximal end 44 on both the power face 36 and non-power face 38 may increase the strength and rigidity of the connection between the skeg/fin 42 and paddle blade 34. The portion 44*a* on the non-power 38 face may provide enhanced fluid flow characteristics over the non-power face 38, and the portion 44*b* may provide enhanced fluid flow characteristics over the power face 36. Note that, depending on the particular embodiment, a skeg/fin according to the invention may have a proximal portion which extends over and/or is secured to the non-power face, the power face, or both. In another embodiment, the skeg/fin may extend directly from the paddle blade lower edge, without extending over the non-power face or power face.

The skeg/fin 42 extends from the paddle blade 34 and terminates in a skeg/fin distal end 48. The skeg/fin 42 in this embodiment is raked toward the non-power face side of the blade 34, such that the majority of the skeg/fin 42 body is positioned on the non-power face side of the blade 34, with only a small portion of the skeg/fin 42 positioned on the power-face side of the blade 34.

The skeg/fin 42 is sized and dimensioned so that the length of the skeg/fin 42 passes down farther than the overall length of the paddle blade 34 and overall paddle 12, and raked toward the non-power side 38 of the blade (i.e., back from the direction in which the paddle blade enters the water). This may create a small amount of drag that may assist in centering the paddle blade in a flat configuration through the water during the stroke. The trailing portion of the skeg/fin may assist in keeping the stroke from oscillating/wobbling, especially in the beginning of the stroke when the speed of the stroke is typically slow.

Figure 3A:
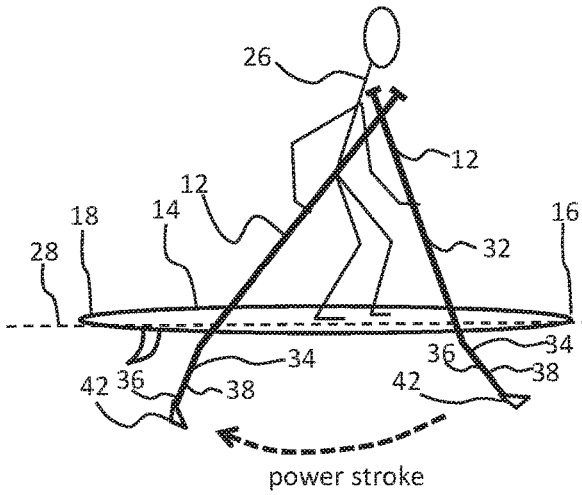
FIGS. 3A-3B depict side views of a system in use by a user according to an embodiment of the invention.

As depicted in FIG. 3A, during a power stroke (i.e., a stroke to propel the board through the water), the user 26 is driving the paddle 12 through the water 28 with the entire blade 34 (or at least the majority of the blade 34) and the skeg/fin 42 within the water with the power face 36 pressing against the water 28 to drive the board 14 across the water 28. The skeg/fin 42 assists the user's paddle stroke to follow straight on a line when the paddle blade 34 and skeg/fin 42 are in the water. In the particular embodiment depicted, the user 26 is driving the board 14 forward, and has the power face 36 facing toward the back 18 of the board 14 and the non-power face facing toward the front 16 of the board 14.

Figure 3B:
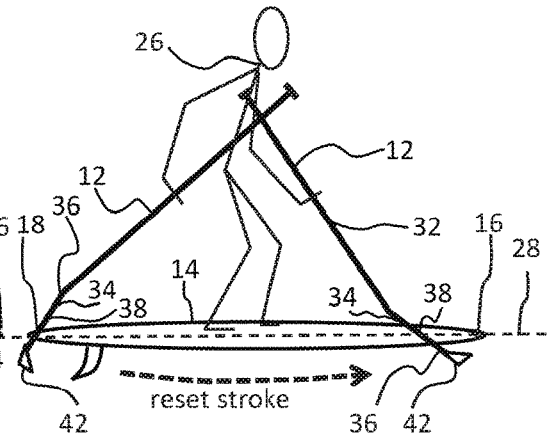

FIG. 3B depicts a return (i.e., non-power) stroke, where the user 26 is pulling the paddle 12 in order to reposition the paddle 12 for a new power stroke. In the particular embodiment depicted, the user 26 is pulling the paddle 12 forward to bring it back toward the front 16 of the board 14 in order to reposition the paddle 12 for a new power stroke. The user 26 may lift the entire paddle 12 out of the water 18 to eliminate paddle-induced drag during the return stroke. Alternatively, as depicted in FIG. 3B, the user 26 may lift the blade 34 clear of the water 18 while dragging the skeg/fin 42 through the water 28. Dragging the skeg/fin 42 through the water 18 during the return stroke can enhance tracking through the water, thus increasing the tendency of the board 14 to track on a relatively straight course. Depending on the desired course, the user can angle the skeg/fin 42 to either side, or straight ahead, during the return stroke, such that the skeg/fin 42 on the return stroke thus serves as a sort of keel or rudder to guide the board 14 on a desired course. The cut of the skeg/fin 42 should glide easily through the water 28 on the return stroke. The return stroke now is not a wasted event as it keeps the board 14 on course and straight.

Figure 4A:
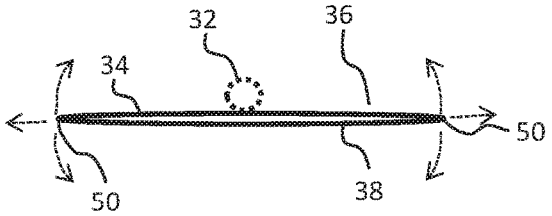
FIGS. 4A-4F depict top (cross-sectional) views of paddle blades according to embodiments of the invention.
Figure 4B:
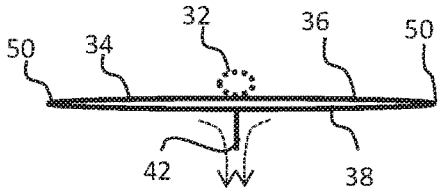
Figure 4C:
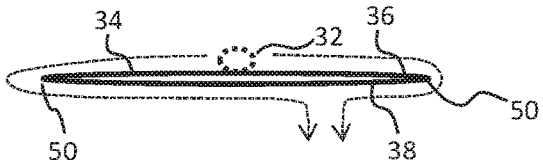
Figure 4D:
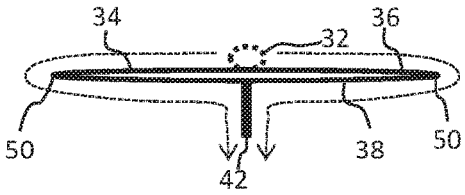
Figure 4E:
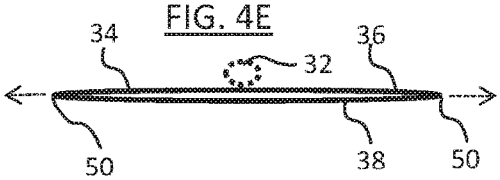
Figure 4F:
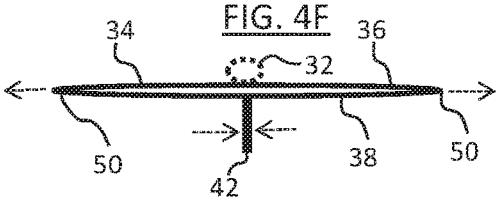

The skeg/fin 42 reduces oscillations/wobbles by balancing out the fluid flow across the paddle blade 34 and/or by physically preventing side-to-side movement of the paddle blade 34 in the water. The result is a more efficient paddle stroke, with the user expending little or no energy to prevent/control side-to-side blade movement during the power stroke. This will enable the user to paddle more easily, and may enable use of a wider paddle blade with significantly reduced oscillations/wobbles. The result is that the user may move more water during each stroke, resulting in a greater thrust to speed ratio, thus traveling faster using less energy. As depicted in FIGS. 4A and 4C, during a power stroke a paddle blade 34 without a skeg/tin may create unequal water flow across the opposing edges 50 of the paddle blade 34 (e.g., where more water flows across one edge as opposed to the other edge), thus causing unequal forces on the opposing sides of the paddle blade and inducing blade oscillations/wobble as the blade 34 is drawn through the water. By contrast, the addition of a skeg/fin 42 as depicted in FIGS. 4B and 4D may help to balance out the water flow across the opposing edges 50, thus balancing the water flow and forces on either side of the blade 34 and reducing oscillations/wobble of the paddle blade 34 as it is forced through the water. The skeg/fin 42 may act as a physical preventer of side-to-side motion, as depicted in FIGS. 4E and 4F. A blade 34 without skeg/fin, as depicted in FIG. 4E, offers little resistance to the water in the sideways directions and can thus easily slide side-to-side in the water. The addition of a skeg/fin 42 as depicted in FIG. 4F may act as a physical obstruction against water flow sideways, with the water pressure on opposite sides of the skeg/fin 42 countering the tendency of the paddle blade 34 to engage in side-to-side movement, thus preventing side-to-side motion of the paddle blade 34 in the water. The portion of the skeg/fin that extends below the paddle blade may be of particular importance, and may help to guide the paddle blade through the water during the power stroke.

Figure 5A:
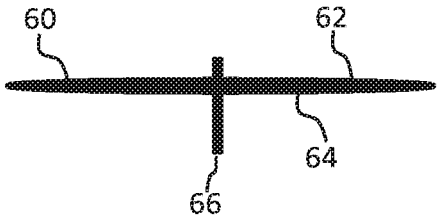
FIGS. 5A and 5B depict end and side (partial) views of a paddle blade and skeg/fin assembly according to an embodiment of the invention.
Figure 5B:
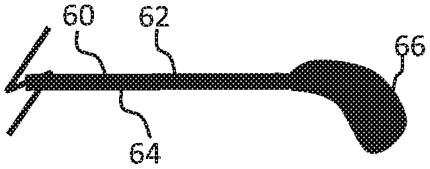
Figure 6A:
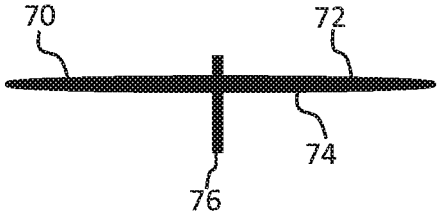
FIGS. 6A and 6B depict end and side (partial) views of a paddle blade and skeg/fin assembly according to an embodiment of the invention.
Figure 6B:
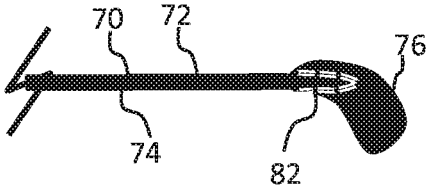
Figure 6C:
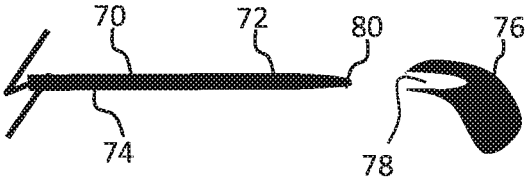
FIG. 6C depicts side (partial) views of the paddle blade and skeg/fin of FIGS. 6A and 6B, in an unassembled configuration.

Various methods for securing a skeg/fin to a paddle blade are envisioned. In some embodiments, the skeg/fin is secured in a permanent (non-removable) manner. For example, as depicted in FIGS. 5A and 5B, a paddle blade 60 having a power side 62 and non-power side 64 may be formed along with the skeg/fin 66 to form a single unitary body. Such an embodiment may be achieved where the paddle blade 60 is formed in a mold (e.g., if the blade is being formed of plastic or similar polymers) and the skeg/fin 66 is formed in the same mold as a single unitary body with the paddle blade 60. In another embodiment a paddle blade 70 with power side 72 and non-power side 74 may have a skeg/fin 76 secured at a distal end 80 thereof via a connection 82 such as adhesive, welding, etc., as depicted in FIGS. 6A through 6C (where FIG. 6C shows the blade and skeg/fin as separate elements, prior to being secured to each other). Note the notch/slot 78 in the skeg/fin 76 which is configured to receive the distal end 80 of the paddle blade 60 therein.

Figure 7A:
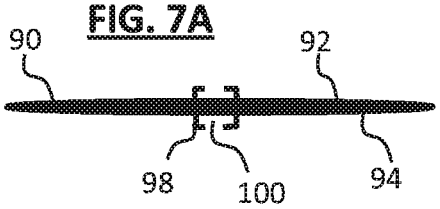
FIG. 7A depicts an end view of a paddle blade with a structure configured to receive a skeg/fin.
Figure 7B:
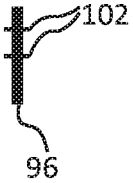
FIG. 7B depicts an end view of a skeg/fin with extending elements to interact with a structure on the paddle blade.
Figure 7C:
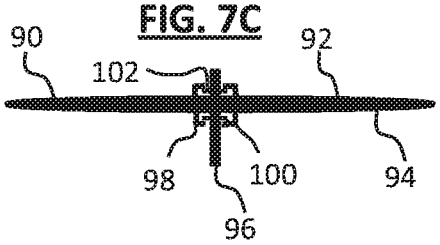
FIG. 7C depicts the paddle blade of FIG. 7A secured to the skeg/fin of FIG. 7B.

A paddle according to the invention may include a paddle blade where the skeg/fin may have a blade-receiving slot therein, so that no slot or other indentation in the blade is necessary. Alternatively, the blade may have a slot or other indentation configured to receive the skeg/fin. Or both the blade and skeg/fin may have indentations/extensions configured to receive or otherwise react with the other. These slots/indentations/extensions can be used (alone or in conjunction with the adhesive/weld/other connections) to enhance the connection between the bond between the blade and skeg/fin. For example, as depicted in FIGS. 7A-7C, a paddle blade 90 having a power side 92 and non-power side 96 may have a structure 98 thereon or therein forming a slot 100 configured to receive the skeg/fin 96 therein. The skeg/fin 96 may have extending elements 102 configured to fit in the slot 100 and help to secure the skeg/fin 96 within the slot 100. Note that these structures/elements could be reversed, with the slot-forming structure positioned on the skeg/fin and the extending elements on the paddle blade.

In some embodiments, the skeg/fin may be removably secured to the blade, such as via removable pressure-sensitive adhesive or heat-activated adhesive (such as an adhesive that becomes softened/liquid when subjected to heat, that then sets into place and locks the skeg/fin to the blade when cooled back down). In other embodiments, the paddle blade may comprise a structure configured to lock or be locked onto a skeg/fin. The lock may be selectively releasable, such as for skeg/fin replacement. For example, a skeg/fin holder may be positioned on the blade, with the skeg/fin holder configured to receive and lock onto a portion of the proximal end of the skeg/fin. Examples of such skeg/fin holders include such as a fin box, similar to known fin boxes used for paddle boards and surf boards, which may be positioned on the blade to receive a skeg/fin. The fin box may be configured to lock (and unlock) the skeg/fin to the blade via known mechanisms, such as via a single set screw. The skeg/fin may have a foot (which may be in a tee shape) that can slide into a channel in the fin box configured to receive the foot shape. The skeg/fin is then locked on (e.g., via a single set screw on one end or the other, or one on each end to better set the skeg/fin to the blade). This permits a user to remove and replace the skeg/fin in case the skeg/fin is damaged or if the user desires to use a different skeg/fin (e.g., a skeg/fin having different shape/size).

Figure 8:
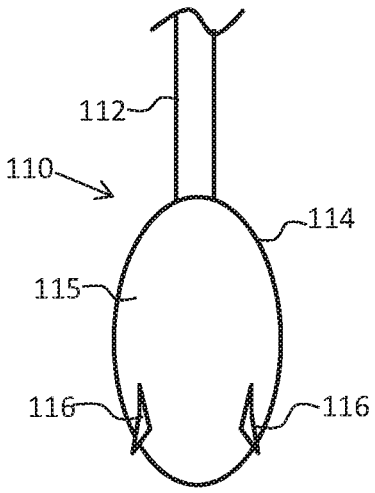
FIG. 8 depicts a perspective view of a paddle blade with skegs/fins according to an embodiment of the invention.
Figure 9:
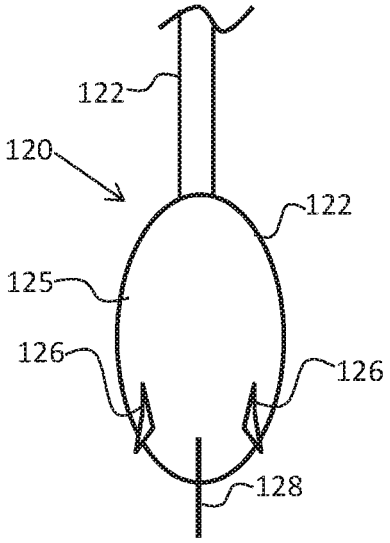
FIG. 9 depicts a perspective view of a paddle blade with skegs/fins according to an embodiment of the invention.
Figure 10:
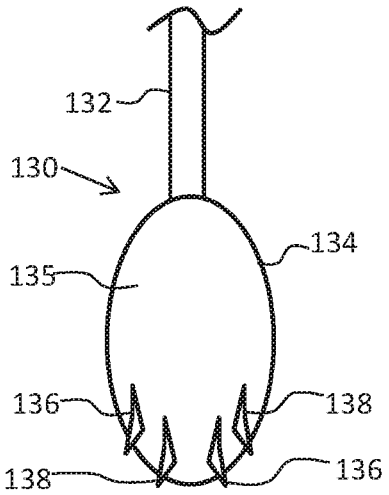
FIG. 10 depicts a perspective view of a paddle blade with skegs/fins according to an embodiment of the invention.
Figure 11:
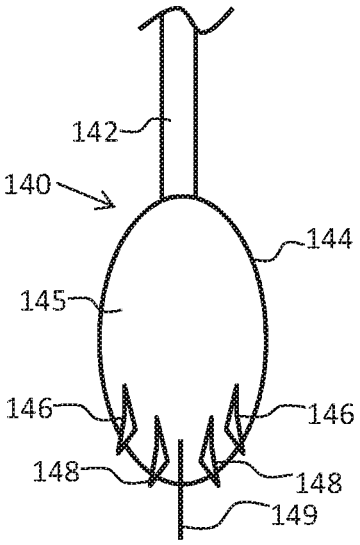
FIG. 11 depicts a perspective view of a paddle blade with skegs/fins according to an embodiment of the invention.

Various numbers and positions of skegs/fins are within the scope of the invention. These different skeg/fin shapes and lengths may be used for different conditions and/or skill levels. For example, there may be one single skeg/fin, which may be attached perpendicularly to the lower section of the blade, and may be centered on the blade as depicted in FIGS. 5A, 6A, 7C. Dual fin setups are also within the scope of the invention, where a paddle 110 with paddle shaft 112 and paddle blade 114 and non-power side 115 has two skeg/fins 116 positioned on the lower section of the blade 114, as depicted in FIG. 8. The two skeg/fins 116 may be positioned equidistant from the blade center (which may be aligned with the paddle shaft 112). There can also be a tri-fin set up, where a paddle 120 with paddle shaft 122 and paddle blade 124 having a non-power side 125 includes two side skeg/fins 126 and one center skeg/fin 128, as depicted in FIG. 9. The center skeg/fin 128 may be centered on the paddle blade 124 and may be in alignment with the paddle shaft 122, and may extend perpendicularly from the paddle blade. The outer side fins 126 may extend perpendicularly from the blade and parallel to the paddle shaft, or may extend at an angle of 70 degrees to perpendicular from the blade and/or at an angle from the paddle shaft. In a further embodiment, as depicted in FIG. 10 a quad-fin set-up involves a paddle blade 130 with paddle shaft 132 and paddle blade 134 with non-power side 135. An outer pair of fins 136 and an inner pair of fins 138 extend from the paddle blade 130. The inner pair 136 and/or outer pair 138 may be positioned equidistant from the paddle blade center, and may be aligned with the paddle shaft 132. FIG. 11 depicts a quint-fin set-up where a paddle blade 140 with paddle shaft 142 and paddle blade 144 with non-power side 145. An outer pair of fins 146 and an inner pair of fins 148 extend from the paddle blade 140. The inner pair 146 and/or outer pair 148 may be positioned equidistant from the paddle blade center, and may be aligned with the paddle shaft 142. A center skeg/fin 149 may be centered on the paddle blade 144 and may be in alignment with the paddle shaft 142. Note that different skeg/fins can extend from different directions (i.e., power and non-power sides) of the paddle blade, even where the fins are all on the same paddle blade. For example, a center skeg/fin may extend from the non-power side, while one or more side skeg/fins may extend from the power side.

Various skeg/fin configurations and sizes are within the scope of the invention. Examples are depicted in FIGS. 12A-12C, which depict side views of various skegs/fins 150, 156, 162 having slots 152, 158, 164 configured to receive and be secured to the lower portion/distal edge of a paddle blade. Note that in the embodiments depicted in FIGS. 12A-12C, the larger side 154, 160, 166 of each skeg/fin 150, 156, 162 is intended to be positioned to extend from the non-power side of the paddle blade. Further examples are depicted in FIGS. 13A-13C, which depict side views of various skegs/fins 168, 174, 180 having slots 170, 176, 182 configured to receive and be secured to the lower portion/distal edge of a paddle blade. Note that in the embodiments depicted in FIGS. 13A-13C, the larger side 172, 178, 184 of each skeg/fin 168, 174, 180 is intended to be positioned to extend from the non-power side of the paddle blade. Note that the skegs/fins in FIGS. 12A-12C and 13A-13C are depicted to scale with an inch ruler for scale. The skegs/fins may be positioned on the blade such that the skeg/fin is parallel to and/or aligned with the paddle shaft. The skegs/fins may be parallel to the direction of travel and/or direction of paddle stroke, and/or perpendicular to the paddle blade.

Figure 14A:
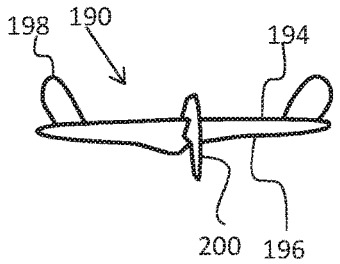
FIGS. 14A-14C depict bottom, perspective (bottom), and perspective (side) views of a paddle blade according to an embodiment of the invention.
Figure 14B:
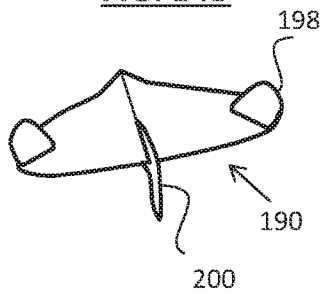
Figure 14C:
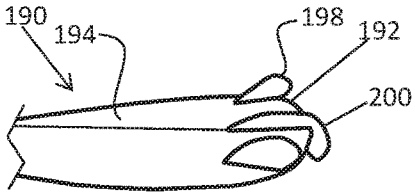

FIGS. 14A-14C depict various views of a paddle blade 190 having three skeg/fins, with a central skeg/fin 200 centered on the blade and extending out from the distal edge 192 of the blade, with most of the central skeg/fin 200 extending on the non-power face side 196 of the paddle blade. The side fins 198 extend from the power face side 194 of the paddle blade 190.

Figure 15:
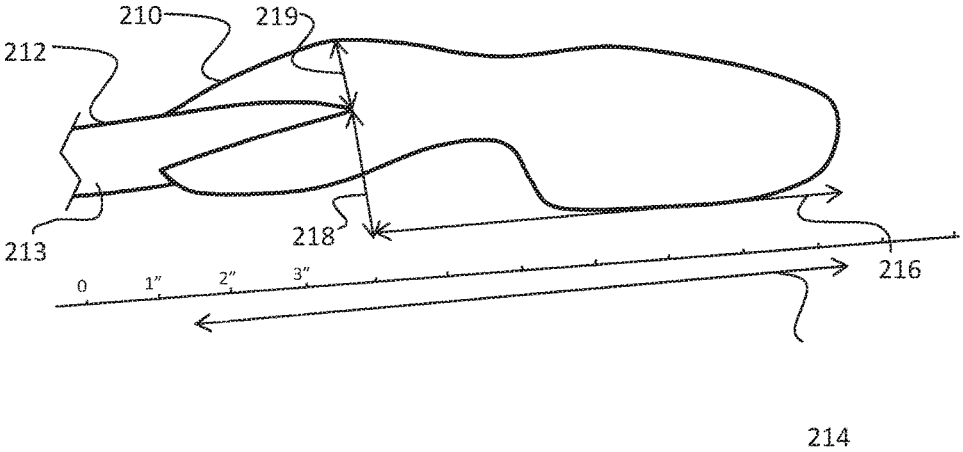
FIG. 15 depicts a side view of a central skeg/fin extending primarily on the non-power face side of a paddle blade.

FIG. 15 depicts a relatively large central skeg/fin 210 extending primarily on the non-power face side 213 of the paddle blade 212. The skeg/fin 210 has an overall length 214 (which in the particular embodiment depicted is 9 inches) and a distally-extending length 216 (which in the particular embodiment is 6 inches). A maximum non-power side width 218 and a maximum power side width 219 are also depicted, and in the particular embodiment are about 2 and 1 inches, respectively. Note that other lengths and widths are within the scope of the invention.

Figure 16:
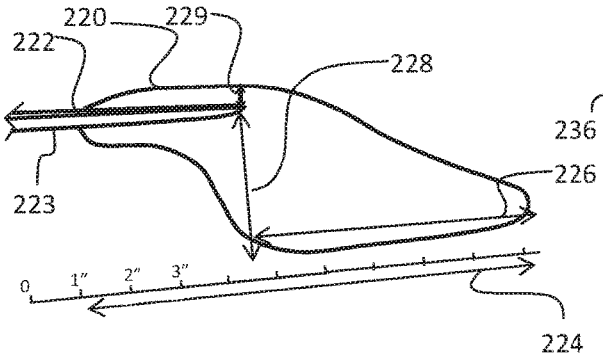
FIG. 16 depicts a side view of a central skeg/fin extending primarily on the non power face side of a paddle blade.

FIG. 16 depicts another central skeg/fin 220 having almost all of its area positioned on the non-power face side 223 of the paddle blade 222. The skeg/fin 220 has an overall length 224 (which in the particular embodiment depicted is 9 inches) and a distally-extending length 226 (which in the particular embodiment is 5 inches). A maximum non-power side width 228 and a maximum power side width 229 are also depicted, and in the particular embodiment are about 3 inches and ½ inches, respectively. Note that other lengths and widths are within the scope of the invention.

Figure 17:
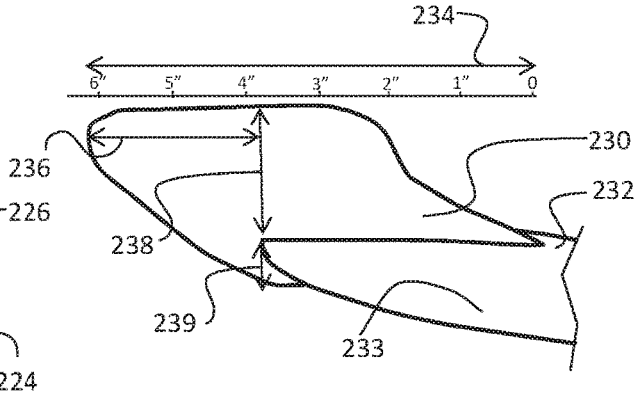
FIG. 17 depicts a side view of a central skeg/fin extending primarily on the non-power face side of a paddle blade.

FIG. 17 depicts another central skeg/fin 230 having almost all of its area positioned on the non-power face side 233 of the paddle blade 232. The skeg/fin 230 has an overall length 234 (which in the particular embodiment depicted is 6-7 inches) and a distally-extending length 236 (which in the particular embodiment is 2-3 inches). A maximum non-power side width 238 and a maximum power side width 239 are also depicted, and in the particular embodiment are about 2 inches and ½ inches, respectively. Note that other lengths and widths are within the scope of the invention.

Note that in several embodiments of the invention, including those depicted in FIGS. 16 and 17, the lower/distal portion of the leading edge of the skeg/fin (i.e., the edge of the skeg/fin extending distally with respect to the blade and facing toward the power face of the blade) is raked/swept backward, which may reduce frictional drag from the skeg/fin while still providing resistance to side-to-side/oscillation/wobble of the paddle blade.

Figure 18A:
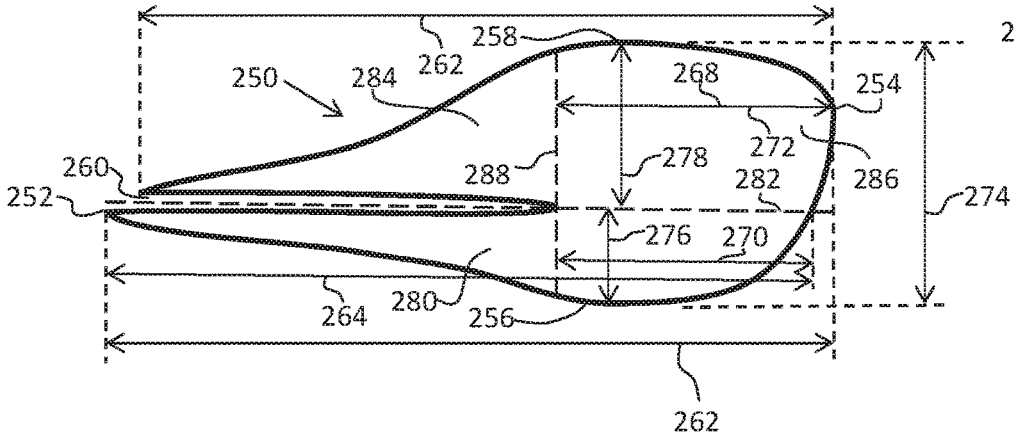
FIGS. 18A-18B depict side and front (proximal) views of a skeg/fin according to an embodiment of the invention.
Figure 18B:
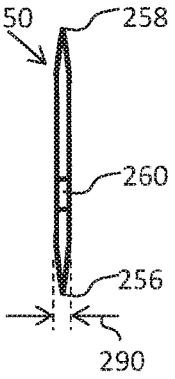

FIGS. 18A and 18B depict a skeg/fin 250 according to an embodiment of the invention, having a proximal end 252, distal end 254, power-side edge 256, non-power side edge 258, and a slot 260 for receiving or otherwise accommodating a paddle blade. The skeg/fin 250 has an overall length 262, a power-side length 264, and a non-power side length 266, as well as a distally-projecting length 268, power-side maximum distally-projecting length 270, and non-power-side maximum distally-projecting length 272. The skeg/fin 250 also has an overall width 274, power-side maximum width 276, and non-power-side maximum width 278. A power-side fin area 280 is defined as the entire fin area (on one side of the fin) that is positioned below the blade line 282 passing through the fin slot 260, with the blade line 282 parallel to and aligned with the slot 260 and any blade therein. A non-power-side fin area 284 is defined as the entire fin area (on one side of the fin) that is positioned above the blade line 282. A distal fin area 286 is defined as the area (on one side of the fin) distal of the distal line 288, with the distal line 288 intersecting the most distal edge of the distal end 254 and running perpendicular to the blade line 282. Note that in the particular embodiment depicted the distal fin area 286 overlaps with both the power-side fin area 280 and non-power-side fin area 284. The fin/skeg 250 has a maximum thickness 290, and is tapered at all edges except edges defining the slot 260.

Note that the distally-projecting length and distal fin area of a skeg/fin according to the invention may be of particular importance in resisting blade wobble and improving blade tracking because this length and area are positioned to engage "free water", i.e., water that has not been disrupted significantly by the paddle blade. Their distal location also allows the area of the skeg/fin to be the first part of the paddle that engages the water during a paddle stroke, and also allows it to be the last part of the paddle that is removed from the water during a paddle stroke. The maximum non-power-side width and non-power side fin area may also be of key importance because their downstream location may provide improved flow characteristics in stabilizing the blade and resisting blade wobble.

Different skegs/fins according to embodiments of the invention, such as those depicted in FIGS. 18A-18B and elsewhere herein, may have various dimensions, depending on the particular application and paddle blade. For example, the blade-receiving slot may have depths of 4 inches, or ranging from 3"-5", etc. Note that this depth corresponds to how far the skeg/fin extends upward along the blade from the distal edge thereof. The blade-receiving slot maximum width depends on the thickness of the blade to be inserted or otherwise accommodated, and may be ¼ inch or so. Different skeg/fins may have different overall lengths, depending on the particular application and paddle blade. For example, overall skeg/fin lengths may range from 3 inches to 7 inches; 4 inches to 6 inches; 5 inches; etc. The skeg/fins overall widths also depend on the particular application and paddle blade, and may preferably be 1 inch to 5 inches; 2 inches to 4 inches; 3 inches; etc. A maximum distal extension may be at least 0.25 inches; at least 0.5 inches; at least 0.75 inches; at least 1 inch; 0.25 inches to 2 inches; 0.5 inches to 1 inch; 0.75 inches; etc. A distal area may be 0.5 to 5 square inches; 1 to 4 square inches; 1.5 to 3 square inches; 2 square inches; 1 inch or more; 1.5 inch or more; 2 inches or more; etc. A maximum power-side width may be 0 inches to 2 inches; 0.5-1.5 inches; 1 inch; etc. A power-side area may be 0 to 5 square inches; 0.25 to 4 square inches; 0.5 to 3 square inches; 0.75 to 2 square inches; 1 square inch; less than 1 square inch; etc. A maximum non-power-side width may be 1 inch to 3 inches; 1.5 inches to 2.5 inches; 2 inches; etc. A non-power-side area may be over 1 square inch; over 1.5 square inch; over 2 square inches; over 3 square inches; over 4 square inches; over 5 square inches; 2 to 8 square inches; 3 to 7 square inches; 4 to 6 square inches; 5 square inches; etc. The skeg/fin thickness may preferably be as small as practical while still preserving proper structural integrity and stiffness, or may have increased thickness over various portions in order to improve fluid flow. The skeg/fin thickness may taper at the edges for improved fluid flow. Maximum skeg/fin thickness of ¼ inch or less, ⅛ inch or less, and other values are within the scope of the invention. The invention is not limited to these widths and lengths and thicknesses and areas, and other values and ranges of such dimension are also within the scope of the invention. Moreover, each and any of the ranges of widths and lengths and thicknesses and areas cited herein may be combined with each and any of the ranges for the other widths and/or lengths and/or thicknesses and/or areas cited herein, in accordance with the invention.

Figure 19:
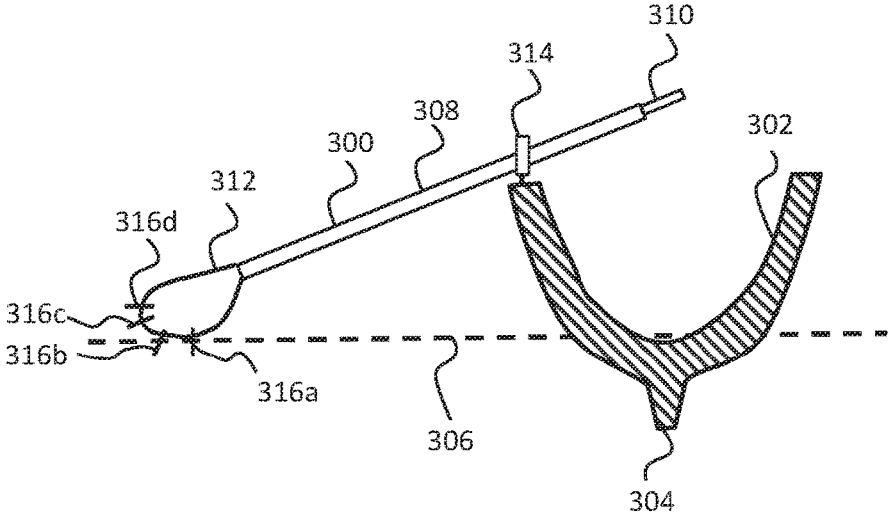
FIG. 19 depicts a front view of a boat with a paddle configured as an oar.

FIG. 19 depicts a paddle 300 being used as an oar for a rowboat 302 or similar craft, which may have a keel 304 extending below the water's surface 306. The paddle 300 has a paddle shaft 308 with a paddle handle 310 at one end and a paddle blade 312 at the other. In the embodiment depicted, the paddle shaft 308 passes through an oar lock 314. The paddle blade 312 has one or more skeg/fins 316*a*, 316*b*, 316*c*, 316*d* thereon. Various positions for the skeg/fins are depicted. The skegs/fins each define planes which are all parallel to the direction of the oar stroke (which is also parallel to the direction of the boat's travel). Skeg/fin 316*a* is also perpendicular to the water's surface 306 as the paddle blade 312 enters the water, so that skeg/fin 316*a* acts as a sort of mini-keel for the paddle blade 312 as it passes through the water during a power stroke and can thus improve tracking/direction of the boat 302 as it is rowed via the paddle 300. Skeg/fin 316*b* extends from the paddle blade 312 at a downward and outward angle with respect to the paddle shaft 308. Skeg/fin 316*c* extends from the paddle blade 312 substantially parallel (i.e., within 5 degrees of parallel), parallel to, and/or aligned with the paddle shaft 308. Skeg/fin 316*d* extends from the paddle blade 312 at an upward and outward angle with respect to the paddle shaft 308. Each of these skeg/fin positions are within the scope of the invention. Each of these skegs/fins can be used individually (i.e., a single skeg/fin on an individual paddle blade), and/or in combination with other skeg/fins and positions (i.e., 2 or more skegs/fins on an individual paddle blade). Each of these skegs/fins may have the dimensions of any of the skegs/fins disclosed elsewhere in this application. Kayak paddles may also use such skegs/fins, wherein a kayak paddle has a paddle shaft, a first paddle blade at a first end of the paddle shaft, and a second paddle blade at the second end of the paddle shaft (e.g., in the position of and replacing the handle 310 depicted in FIG. 19).

Note that fins according to the invention may be centered on the paddle blade or non-center (i.e., toward the sides of the blade). Fins may be in alignment with the paddle shaft, and/or may define planes which are parallel to the paddle shaft. Fins may be non-parallel to the paddle shaft. For example, a center fin may be positioned centered on the blade and may be perpendicular to the blade, but defining a plane that is at an angle (such as 2 to 10 degrees; 3 to 8 degrees; 4 to 6 degrees; etc.) out of alignment with the paddle shaft, thus providing somewhat different steering depending on whether the paddle stroke occurs on the left side or the right side of a water craft. Fins may extend perpendicularly from the paddle blade. Fins may extend at an angles from the paddle blade such as between 30 and 60 degrees; between 45 and 75 degrees; between 60 and 80 degrees; between 60 and 90 degrees; between 75 and 90 degrees; 90 degrees; etc.

While the invention has been described in its preferred embodiments, it is to be understood that the words which have been used are words of description and not of limitation. Therefore, changes may be made within the appended claims without departing from the true scope of the invention.

What is claimed is:

1. A paddle comprising:

a paddle shaft;

a paddle blade having a lower end portion, a distal edge, a power side, and a non-power side; and a skeg/fin extending from the lower end portion of the paddle blade, the skeg/fin oriented perpendicular to the paddle blade and extending out and away from the non-power side of the paddle blade, wherein the skeg/fin extends distally from the distal edge of the paddle blade a distance of at least 0.5 inches.

2. The paddle of claim 1, wherein the skeg/fin extends distally from the distal edge of the paddle blade a distance of at least 1 inches.

3. The paddle of claim 1, wherein the skeg/fin comprises a side profile area, and the portion of the side profile area positioned distally of the distal edge of the paddle blade comprises at least 1 square inches.

4. The paddle of claim 3, wherein the portion of the side profile area positioned distally of the distal edge of the paddle blade comprises at least 2 square inches.

5. The paddle of claim 1, wherein the skeg/fin extends outward from the non-power side of the paddle blade a distance of at least 1 inches.

6. The paddle of claim 5, wherein the skeg/fin extends outward from the non-power side of the paddle blade a distance of at least 2 inches.

7. The paddle of claim 1, wherein the skeg/fin comprises a side profile area, and the portion of the side profile area of the fin that extends outward from the non-power side comprises at least 2 square inches.

8. The paddle of claim 1, wherein the portion of the side profile area of the fin that extends outward from the non-power side comprises at least 3 square inches.

9. The paddle of claim 1, wherein the fin comprises a thickness of 0.25 inches or less across most of the fin.

10. A fin configured for attachment to a paddle blade, the fin defining a fin plane, the fin further comprising:

a blade-engaging element configured to engage a distal portion of a paddle blade, wherein the fin comprises a side profile area of at least 1 square inch, wherein the fin comprises a thickness of 0.25 inches or less across most of the fin, wherein the blade-engaging element comprises:

a slot passing through the fin and sized and configured to receive a paddle blade therein with the paddle blade generally perpendicular to the plane of the fin, the slot having a proximal opening, a closed distal end, a power side, and a non-power side, wherein the power side and the non-power side are opposing sides of the slot.

11. The fin of claim 10, wherein the fin extends distally from the distal end of the slot a distance of at least 0.5 inches.

12. The fin of claim 10, wherein the portion of the side profile area positioned distally of the distal edge of the paddle blade comprises at least 1 square inch.

13. The fin of claim 10, wherein the fin extends perpendicularly away from the non-power side of the slot a distance of at least 1 inch.

14. The fin of claim 10, wherein the side profile are of the fin comprises at least 2.5 square inches, and the portion of the side profile area of the fin that extends outward from the non-power side comprises at least 2 square inches.

15. A method of modifying a paddle, comprising:

providing a paddle, wherein the paddle comprises a paddle shaft and a paddle blade, wherein the paddle blade comprises a distal portion;

providing a fin, wherein the fin is configured to engage the distal portion of the paddle blade therewithin, the fin defining a fin plane, the fin further comprising:

a blade-engaging element configured to engage a distal portion of a paddle blade, wherein the fin comprises a side profile area of at least 1 square inch, wherein the fin comprises a thickness of 0.25 inches or less across most of the fin, wherein the blade-engaging element comprises a slot passing through the fin and sized and configured to receive a paddle blade therein with the paddle blade generally perpendicular to the plane of the fin, the slot having a proximal opening, a closed distal end, a power side, and a non-power side, wherein the power side and the non-power side are opposing sides of the slot;

positioning the distal portion of the paddle blade in engagement with the blade-engaging element of the fin; and securing the distal portion of the paddle blade to the blade-engaging element of the fin with a portion of the fin extending outward from the non-power surface of the paddle blade.

16. The method of claim 15, wherein securing the distal portion of the paddle blade to the fin comprises using adhesive.

17. A paddle comprising:

a paddle shaft;

a paddle blade having a lower end portion, a distal edge, a power side, and a non-power side; and a skeg/fin extending from the lower end portion of the paddle blade, the skeg/fin oriented perpendicular to the paddle blade and extending out and away from the non-power side of the paddle blade, wherein the skeg/fin extends in a continuous form from the power side of the paddle blade, around the distal end of the paddle blade, and to the non-power side of the paddle blade, wherein the skeg/fin extends distally from the distal edge of the paddle blade a maximum distal distance of 0.25 to 2 inches, and the skeg/fin extends perpendicularly away from the non-power side of the paddle blade a maximum non-power side distance of 1 to 3 inches.

* * * * *